US012044253B2

(12) United States Patent
Wu

(10) Patent No.: US 12,044,253 B2
(45) Date of Patent: Jul. 23, 2024

(54) RECIPROCATING PUMP SYSTEMS

(71) Applicant: NATIONAL OILWELL VARCO, L.P., Houston, TX (US)

(72) Inventor: Samuel S. Wu, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 97 days.

(21) Appl. No.: 16/760,822

(22) PCT Filed: Oct. 30, 2018

(86) PCT No.: PCT/US2018/058255
§ 371 (c)(1),
(2) Date: Apr. 30, 2020

(87) PCT Pub. No.: WO2019/089624
PCT Pub. Date: May 9, 2019

(65) Prior Publication Data

US 2020/0355173 A1 Nov. 12, 2020

(51) Int. Cl.
*F04F 5/54* (2006.01)
*F04B 11/00* (2006.01)
(Continued)

(52) U.S. Cl.
CPC ..... *F04F 5/54* (2013.01); *F04B 11/00* (2013.01); *F04B 15/02* (2013.01); *F04B 47/00* (2013.01);
(Continued)

(58) Field of Classification Search
CPC ..... F04F 1/00; F04F 1/18; F04F 1/20; F04F 5/00; F04F 5/02; F04F 5/10; F04F 5/54;
(Continued)

(56) References Cited

U.S. PATENT DOCUMENTS 4,032,265 A * 6/1977 Miller ..... F04B 11/0016 417/540
4,135,861 A 1/1979 Brown et al.
(Continued)

FOREIGN PATENT DOCUMENTS

JP H07259800 A * 10/1995 ..... F04F 5/10
JP 2014031760 A * 2/2014 ..... F04F 5/10
JP 2014092065 A * 5/2014 ..... F04F 5/04

OTHER PUBLICATIONS

Author: Mekanizmalar Title: Fixed displacement piston pump Date published (mm/dd/yyyy): Oct. 14, 2010 Date accessed: Dec. 14, 2021 Link: https://www.youtube.com/watch?v=8I5FtW2E4_A (Year: 2010).*
International Search Report and Written Opinion dated Feb. 25, 2019, for International Application No. PCT/US2018/058255.

*Primary Examiner* — Devon C Kramer
*Assistant Examiner* — Chirag Jariwala
(74) *Attorney, Agent, or Firm* — Conley Rose, P.C.

(57) ABSTRACT

A reciprocating pump system includes a reciprocating pump including a fluid end configured to receive a suction fluid flow and discharge a discharge fluid flow, and a suction booster assembly coupled to the fluid end, the suction booster assembly including a venturi including a venturi passage, and a jet configured to jet a fluid received from the discharge of the fluid end into the venturi passage, wherein the suction booster assembly is configured such that the jet of the suction booster assembly jetting the fluid into the venturi passage increases the pressure of the suction fluid flow.

22 Claims, 7 Drawing Sheets

(51) Int. Cl.

| | |
|---|---|
| ***F04B 15/02*** | (2006.01) |
| ***F04B 47/00*** | (2006.01) |
| ***F04B 53/10*** | (2006.01) |
| ***F04B 53/20*** | (2006.01) |

(52) U.S. Cl.
CPC ..... *F04B 53/10* (2013.01); *F04B 53/20* (2013.01); *F04B 2205/01* (2013.01); *F04B 2205/12* (2013.01)

(58) Field of Classification Search
CPC ..... F04B 1/00; F04B 1/04; F04B 9/00; F04B 9/02; F04B 9/04; F04B 9/045; F04B 15/00; F04B 15/02; F04B 17/00; F04B 17/03; F04B 17/06; F04B 19/00; F04B 19/04; F04B 23/00; F04B 23/02; F04B 23/025; F04B 23/04; F04B 23/08; F04B 23/10; F04B 23/14; F04B 47/00; F04B 49/00; F04B 49/22; F04B 49/24; F04B 53/00; F04B 53/04; F04B 53/10; F04B 53/20; F04B 19/20; F04B 19/22; F04B 49/08; F04B 53/16; E21B 43/00; E21B 43/12; E21B 43/121; E21B 43/124; E21B 43/25; E21B 43/26; E21B 43/2607; E21B 21/00
See application file for complete search history.

(56) References Cited

U.S. PATENT DOCUMENTS

| | | | | |
|---|---|---|---|---|
| 4,400,138 | A * | 8/1983 | Baer | B01F 25/314 417/195 |
| 4,471,907 | A * | 9/1984 | Gerstmann | F24D 3/02 137/565.22 |
| 4,487,553 | A * | 12/1984 | Nagata | F04F 5/466 417/171 |
| 5,954,481 | A * | 9/1999 | Baier | F04F 5/461 417/151 |
| 6,457,529 | B2 | 10/2002 | Calder et al. | |
| 9,222,320 | B2 | 12/2015 | Varpe | |
| 2005/0002797 | A1* | 1/2005 | Morishima | F04F 5/461 417/182 |
| 2006/0225886 | A1 | 10/2006 | Johnson et al. | |
| 2010/0111718 | A1* | 5/2010 | Schultz | F16H 57/0402 417/313 |
| 2010/0290924 | A1* | 11/2010 | Becker | F04F 5/50 417/79 |
| 2011/0223039 | A1* | 9/2011 | Fang | F04D 9/06 417/54 |
| 2014/0246095 | A1* | 9/2014 | Ellis | F04F 5/24 137/1 |
| 2015/0300109 | A1* | 10/2015 | Yajure | E21B 21/01 166/373 |
| 2015/0361994 | A1 | 12/2015 | Furet et al. | |

* cited by examiner

RECIPROCATING PUMP SYSTEMS

CROSS-REFERENCE TO RELATED APPLICATIONS

This application claims benefit of U.S. provisional patent application Ser. No. 62/580,294 filed Nov. 1, 2017, and entitled "Reciprocating Pump Systems," which is hereby incorporated herein by reference in its entirety.

STATEMENT REGARDING FEDERALLY SPONSORED RESEARCH OR DEVELOPMENT

Not applicable.

BACKGROUND

Reciprocating pumps (e.g., piston pumps, plunger pumps, diaphragm pumps, etc.) are used in a variety of applications for providing fluid flow. For instance, for the recovery of hydrocarbons or minerals from a subsurface formation using a drilling system, it is typical practice to connect a drill bit onto the lower end of a drillstring formed from a plurality of pipe joints connected together end-to-end, and then rotate the drillstring so that the drill bit progresses downward into the earth to create a borehole along a predetermined trajectory. Drilling fluid or "mud" is typically pumped under pressure down the drillstring using a mud pump located at the surface. The drilling mud flows out of a face of the drill bit and into the borehole, and then up the annulus between the drillstring and the borehole sidewall to the surface. Mud pumps often comprise plunger or piston reciprocating pumps having multiple plungers/pistons (e.g., duplex pumps, triplex pumps, quintuplex pumps, etc.) that are configured to circulate the drilling mud under high pressure (e.g., pressures greater than 1,000 pounds per square inch (PSI)). Mud pumps typically comprise a fluid end that receives a suction flow of drilling mud and outputs a discharge flow of pressurized drilling mud, and a power end that provides the reciprocating motion to the one or more plungers/pistons of the mud pump responsible for creating the suction and discharge fluid flows.

SUMMARY

An embodiment of a reciprocating pump system comprises a reciprocating pump including a fluid end configured to receive a suction fluid flow and discharge a discharge fluid flow, and a suction booster assembly coupled to the fluid end, the suction booster assembly comprising a venturi including a venturi passage, and a jet configured to jet a fluid received from the discharge of the fluid end into the venturi passage, wherein the suction booster assembly is configured such that the jet of the suction booster assembly jetting the fluid into the venturi passage increases the pressure of the suction fluid flow. In some embodiments, the suction booster assembly comprises an inlet adapter coupled to the venturi, wherein the inlet adapter comprises a central passage and an angled passage spaced from the central passage that receives the jet. In some embodiments, the jet of the suction booster assembly includes a nozzle extending along a jet axis disposed at a non-zero angle to a central axis of the venturi passage. In certain embodiments, the suction booster assembly comprises a plurality of jets configured to jet the fluid received from the discharge of the fluid end into the venturi passage, and wherein the inlet adapter comprises a plurality of angled passages circumferentially spaced about the central passage of the inlet adapter. In certain embodiments, the inlet adapter of the suction booster assembly has an outer surface comprising an annular channel that is in fluid communication with the plurality of angled passages. In some embodiments, the venturi passage of the suction booster assembly is defined by an inner surface that comprises a converging section, a throat, and a diverging section. In some embodiments, the system further comprises a backflow line configured to divert a portion of the discharge fluid flow to the jet of the suction booster assembly, wherein the backflow line includes a filter coupled to the backflow line and configured to filter debris from the discharge fluid flow provided to the jet. In certain embodiments, the system further comprises a bypass line including a first end coupled to the backflow line at a first location that is upstream of a first valve of the bypass line, and a second end coupled to the backflow line at a second location that is between the filter and a second valve of the bypass line, and a drain line including a first end coupled to the backflow line at a third location that is between the first valve of the backflow line and the filter, wherein the bypass line is configured to backflush the filter in response to closing the first valve and the second valve of the backflow line. In certain embodiments, the system further comprises a pulsation dampener coupled to the fluid end of the reciprocating pump and the suction booster assembly, wherein the pulsation dampener is configured to dampen pulsations in pressure or flowrate of the suction fluid flow received by the fluid end.

An embodiment of a jet pump for increasing suction pressure of a reciprocating pump comprises a venturi including a venturi passage, and an inlet adapter coupled to the venturi and comprising a central passage and an angled passage that receives a jet, wherein the jet includes a nozzle extending along a jet axis disposed at a non-zero angle to a central axis of the venturi passage. In some embodiments, the angled passage is radially spaced from the central passage of the inlet adapter. In some embodiments, the jet pump further comprises a plurality of jets each including a nozzle extending along a jet axis disposed at non-zero angles to the central axis of the venturi passage, wherein the inlet adapter comprises a plurality of angled passages circumferentially spaced about the central passage of the inlet adapter. In certain embodiments, the inlet adapter of the suction booster assembly has an outer surface comprising an annular channel that is in fluid communication with the plurality of angled passages. In certain embodiments, the venturi passage is defined by an inner surface that comprises a converging section, a throat, and a diverging section. In some embodiments, the jet axis intersects the central axis of the venturi passage of the jet pump at a location in the venturi passage that, in a side view of the venturi passage, is defined by the diverging section of the inner surface of the venturi passage. In some embodiments, the inlet adapter comprises a radial port in fluid communication with the angled passage, and wherein the inlet adapter is configured to receive a portion of a fluid flow discharged by the reciprocating pump.

An embodiment of a method for increasing suction pressure of a reciprocating pump comprises (a) diverting a portion of a discharge fluid flow from a discharge line coupled to the reciprocating pump, (b) increasing a flow velocity of the diverted discharge fluid flow by jetting the diverted discharge fluid flow from a nozzle of a jet, (c) jetting the diverted discharge fluid flow into a suction fluid flow, and (d) flowing the suction fluid flow through a venturi passage. In some embodiments, the method further comprises (e) increasing the flow velocity of the diverted discharge fluid flow by jetting the diverted discharge fluid flow from a plurality of jets that are radially spaced from a central axis of the venturi passage. In some embodiments, the method further comprises (e) jetting the diverted discharge fluid flow into the suction fluid flow along a jet axis that is disposed at a non-zero angle to a central axis of the venturi passage. In certain embodiments, the method further comprises (e) flowing the suction fluid flow through a pulsation dampener coupled to the reciprocating pump. In certain embodiments, the method further comprises (e) flowing the diverted discharge fluid flow through a filter located upstream of the jet, and (f) reversing a direction of the diverted discharge fluid flow through the filter to remove debris from the filter.

BRIEF DESCRIPTION OF THE DRAWINGS

For a detailed description of disclosed exemplary embodiments, reference will now be made to the accompanying drawings in which.

DETAILED DESCRIPTION OF DISCLOSED EXEMPLARY EMBODIMENTS

Figure 1:
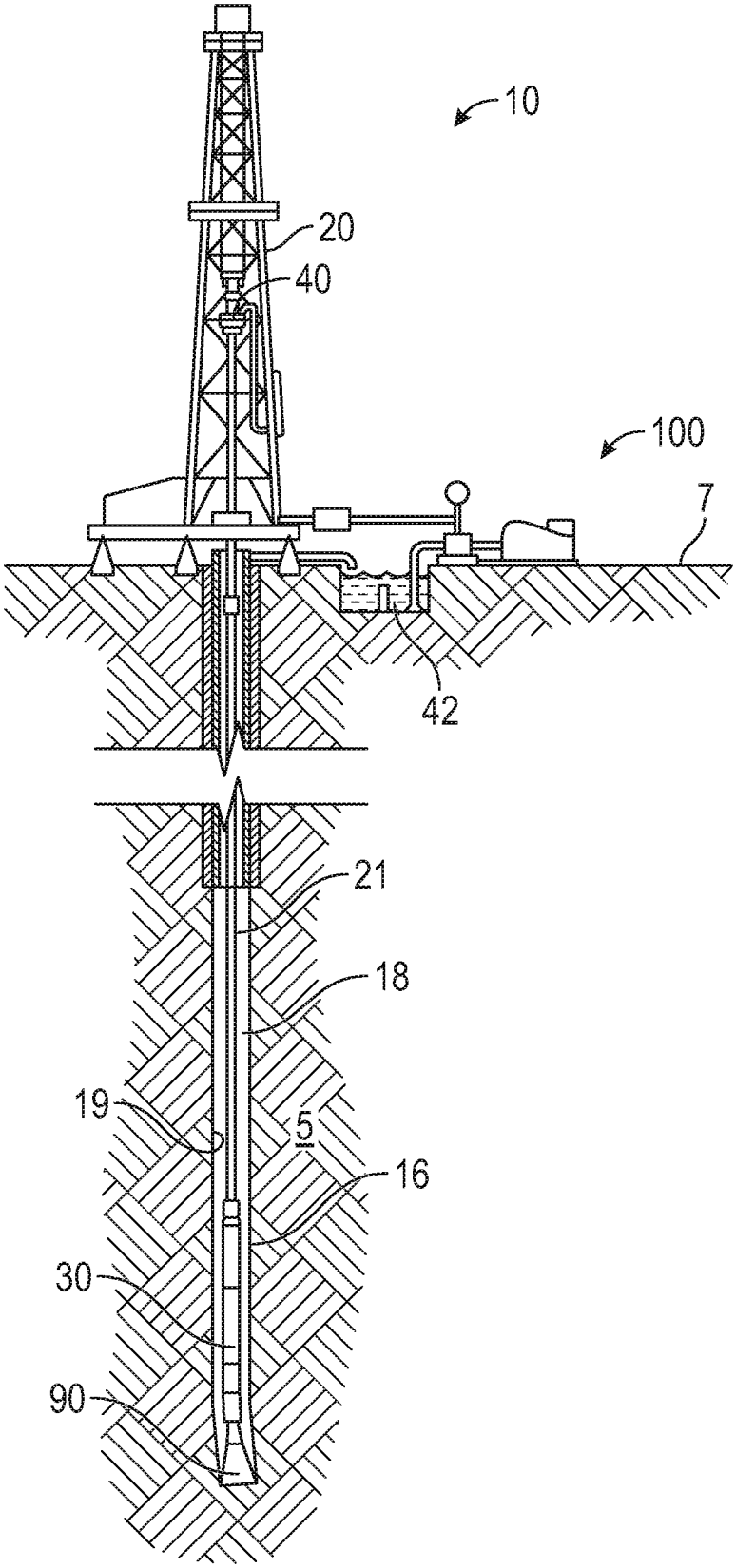
FIG. 1 is a schematic partial cross-sectional view of an embodiment of a drilling system including a reciprocating pump system in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement or connection of the two devices, or through an indirect connection as accomplished via other intermediate devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, an embodiment of a well or drilling system 10 is shown. Drilling system 10 is generally configured for drilling a borehole 16 extending through an earthen formation 5 from a surface 7. In the embodiment of FIG. 1, drilling system 10 includes a drilling rig 20 disposed at the surface 7, a drillstring 21 extending downhole from rig 20, a bottomhole assembly (BHA) 30 coupled to the lower end of drillstring 21, and a drill bit 90 attached to the lower end of BHA 30. In this embodiment, a reciprocating or mud pump system 100 is positioned at the surface 7 and pumps drilling fluid or mud through drillstring 21 via a kelly 40 coupled to an upper end of drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive which may also be used to provide pressurized drilling fluid to drillstring 21 in lieu of the kelly 40.

In some embodiments, BHA 40 may include a downhole mud motor for converting the fluid pressure of the drilling fluid pumped downward through drillstring 21 by mud pump system 100 into rotational torque for driving the rotation of drill bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drillstring 21 and through BHA 30 passes out of the face of drill bit 90 and back up the annulus 18 formed between drillstring 21 and the wall 19 of borehole 16. The drilling fluid cools the bit 90, and flushes the cuttings away from the face of bit 90 and carries the cuttings to the surface 7 where the recirculated drilling fluid is received in a fluid source or mud pit 42. At the surface 7 the drilling fluid recirculated from borehole 16 may be conditioned or treated (e.g., to remove drill cuttings or other debris from the drilling fluid, etc.) prior to being pumped back into drillstring 21 via mud pump system 100 and kelly 40.

Figure 2:
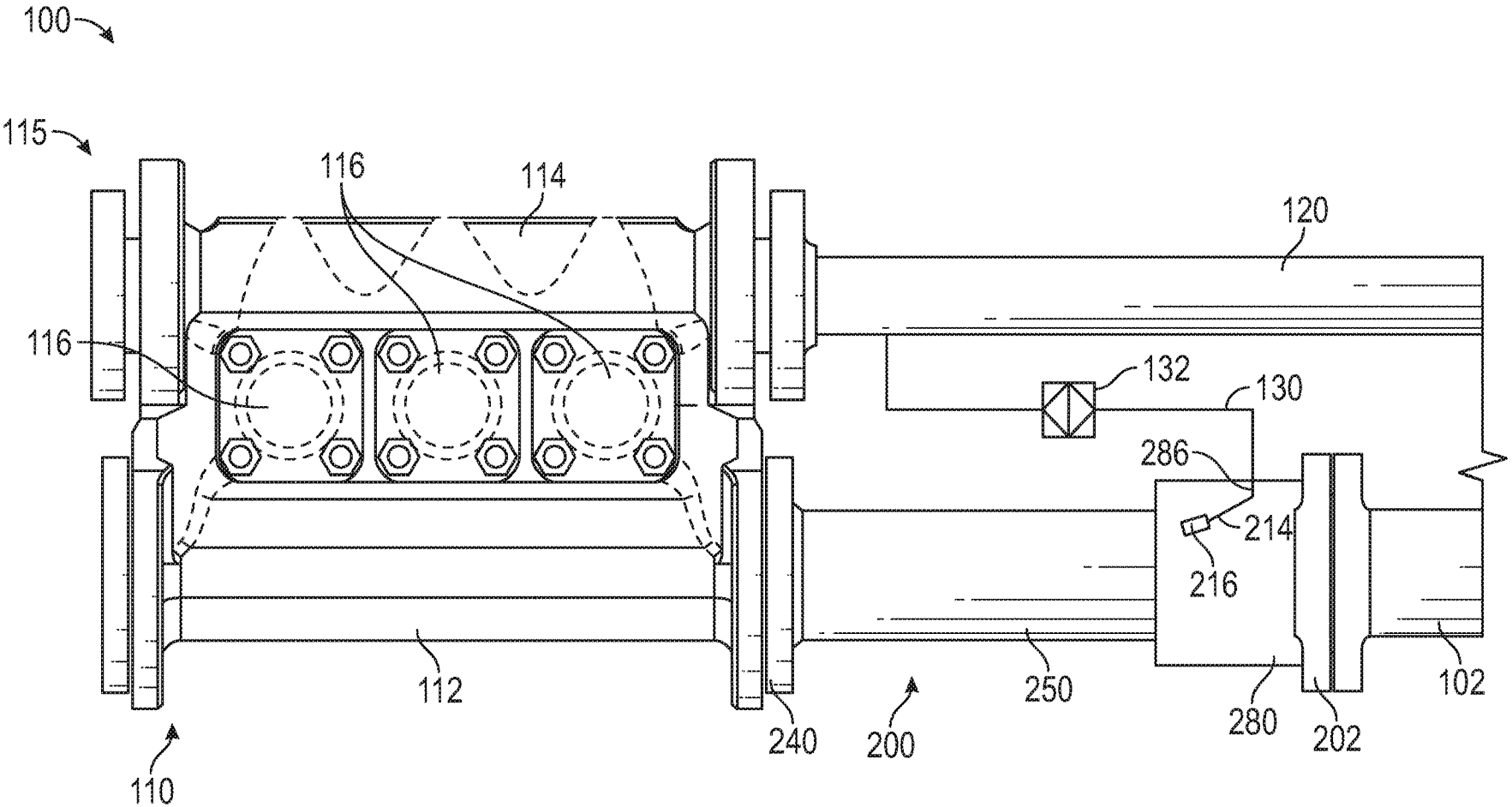
FIG. 2 is a side view of an embodiment of the reciprocating pump system of FIG. 1 in accordance with principles disclosed herein.

Referring to FIGS. 1, 2, an embodiment of the mud pump system 100 of drilling system 10 is shown in FIG. 2. In the embodiment of FIG. 2, mud pump system 100 generally includes a suction line or conduit 102, a fluid end 110, a discharge line or conduit 120, and a jet pump or suction booster assembly 200. Suction line 102 receives drilling fluid from mud pit 42 and drilling fluid discharged through discharge line 120 flows into kelly 40 where it is supplied to drillstring 21 of drilling system 10. In this embodiment, fluid end 110 generally includes a suction manifold 112 coupled to suction booster assembly 200, a discharge manifold 114 coupled to discharge line 120, and a plurality of fluid end modules 116 coupled between the suction manifold 112 and discharge manifold 114. Although in this embodiment mud pump system 100 is used in drilling system 10, in other embodiments, mud pump system 100 may be used in other drilling or well systems (e.g., offshore well systems) as well as in applications other than well systems.

In this embodiment, each fluid end module 116 of fluid end 110 includes a cylindrical bore that receives a piston or plunger. Mud pump system 100 also includes a power end (not shown in FIG. 2) coupled to fluid end 110, where the combination of the power end and fluid end 110 form a triplex reciprocating pump 115. Although in this embodiment reciprocating pump 115 comprises a triplex pump, in other embodiments, pump 115 may comprise another type of multiplex pump (e.g., duplex, quintuplex, etc.) or a pump including only a single plunger/piston. In other embodiments, pump 115 may comprise another type of reciprocating pump other than a plunger or piston pump, such as a diaphragm pump. Pump 115 is configured to discharge drilling fluid into discharge line 120 at high pressure. In this embodiment, drilling fluid is discharged from pump 115 at pressures at or above 5,000 PSI; however, in other embodiments, the discharge pressure of pump 115 may vary. For instance, in some embodiments, drilling fluid may be discharged from pump 115 at pressures below 5,000 PSI; in other embodiments, drilling fluid may be discharged from pump 115 at pressures over 10,000 PSI.

The power end of mud pump system 100 includes a reciprocating drive (e.g., crankshaft, connecting rods, etc.) that reciprocates the plungers/pistons through their respective cylindrical bores formed in fluid end module 116. Particularly, each plunger/piston of pump 115 includes a suction stroke where the plunger/piston travels draws fluid into its respective fluid end module 116 from suction manifold 112, and a discharge stroke where the plunger/piston discharges fluid from its respective fluid end module 116 into discharge manifold 114. Given that pump 115 discharges drilling fluid into discharge line 120 via the reciprocating movement of its respective plungers/pistons, the flow rate of drilling fluid discharged from pump 115 varies over time. In other words, pump 115 provides a pulsating flow of fluid (e.g., pulsating fluid flowrate and/or fluid velocity over time) from suction line 102 into pump 115, and from pump 115 into discharge line 120. Additionally, the resistance of drilling fluid flowing through suction line 102 to accelerations or changes in fluid flowrate and/or fluid velocity (e.g., the impedance of the drilling fluid) may periodically or intermittently decrease the amount of Net Positive Suction Head (NPSH) provided to the suction manifold 112 by the drilling fluid flowing through suction line 102, a phenomena sometimes referred to as "acceleration head." As will be described further herein, suction booster assembly 200, which is disposed between suction line 102 and suction manifold 112, is configured to boost the pressure or NPSH provided to suction manifold 112 to prevent cavitation in the drilling fluid flowing into suction manifold 112 that may result from insufficient NPSH.

In this embodiment, mud pump system 100 also includes a backflow line or conduit 130 extending between discharge line 120 and suction booster assembly 200. As will be described further herein, backflow line 130 diverts or bleeds a portion of the drilling fluid flowing through discharge line 120 to suction booster assembly 200. In this embodiment, backflow line 130 diverts approximately 5%-20% from discharge line 120 to suction booster assembly 200; however, in other embodiments, the percentage of drilling fluid diverted from discharge line 120 by backflow line 130 may vary. Additionally, in this embodiment, backflow line 130 includes a filter 132 for filtering out particulates of a predetermined size from the drilling fluid flowing through backflow line 130 towards suction booster assembly 200.

Figure 3:
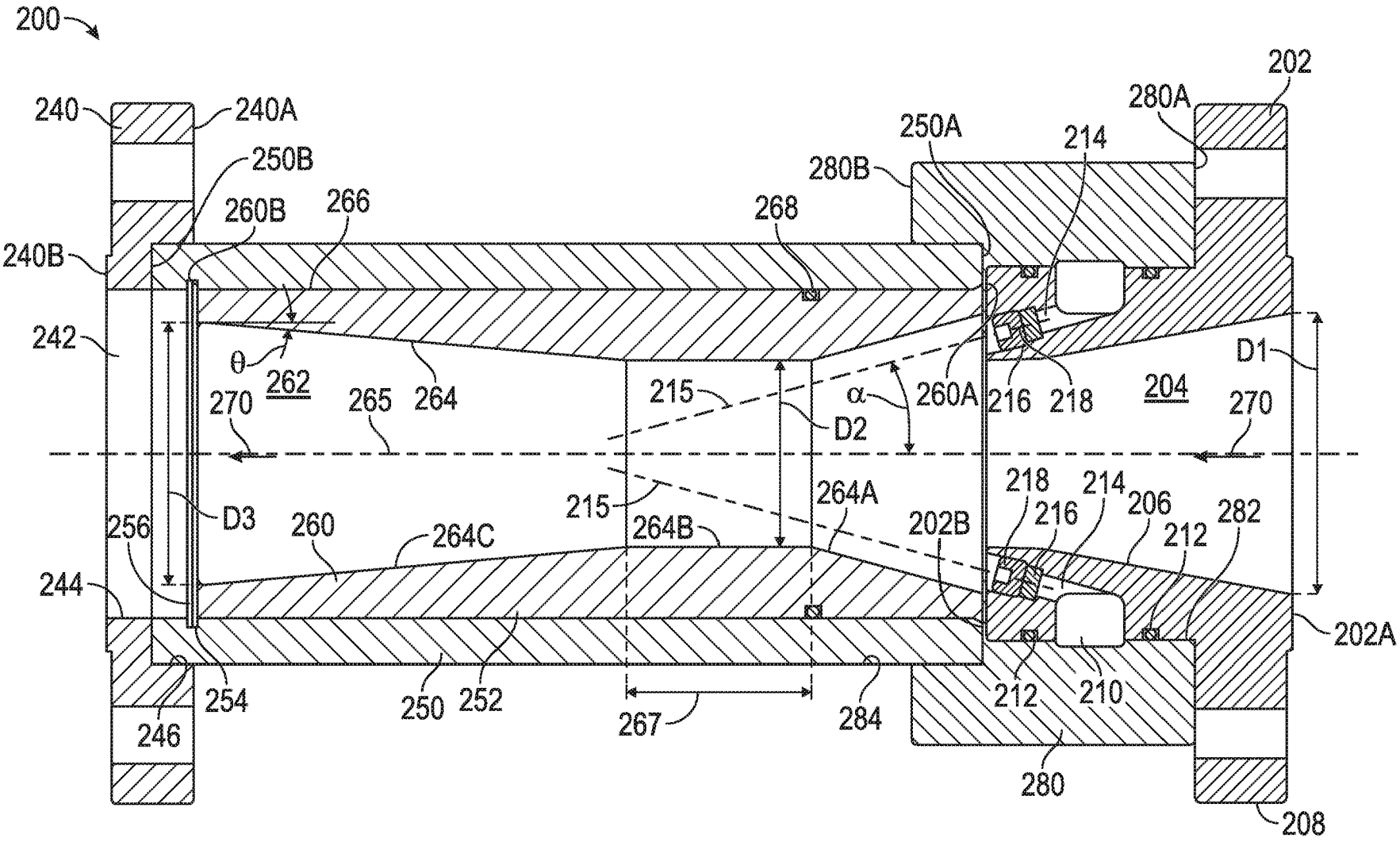
FIG. 3 is a side cross-sectional view of an embodiment of a suction booster assembly of the reciprocating pump system of FIG. 2 in accordance with principles disclosed herein.

Referring to FIGS. 1-3, an embodiment of the suction booster assembly 200 of mud pump system 100 is shown in FIG. 3. In the embodiment of FIG. 3, suction booster assembly 200 generally includes a first or inlet adapter 202, an outlet adapter 240, a cylinder 250, a venturi 260, and a housing 280. Inlet adapter 202 of suction booster assembly 200 is generally cylindrical and has a first or inlet end 202A, a second or outlet end 202B opposite inlet end 202A, a central bore or passage 204 defined by a generally cylindrical inner surface 206 extending between ends 202A, 202B, and a generally cylindrical outer surface 208 extending between ends 202A, 202B. In this embodiment, the inlet end 202A of inlet adapter 202 couples with an end of suction line 102 (e.g., via releasable fasteners). At least a portion of the inner surface 206 of inlet adapter 202 comprises a frustoconical surface 206 extending from inlet end 202A that decreases in diameter from a first or inlet diameter D1 positioned at inlet end 202A to a second or outlet diameter at outlet end 202B that is less than the inlet diameter D1, causing passage 204 of inlet adapter 202 to converge moving from inlet end 202A towards outlet end 202B.

The outer surface 208 of inlet adapter 202 includes an annular groove or channel 210 extending radially therein and a pair of annular seals 212 disposed therein, where one seal 212 is positioned adjacent each side of channel 210 to restrict fluid communication between channel 210 and the environment surrounding suction booster assembly 200. Inlet adapter 202 additionally includes a plurality of circumferentially spaced angled passages 214 (shown schematically in FIG. 2) extending between channel 210 and the outlet end 202B of inlet adapter 202. Received in each angled passage 214 of inlet adapter 202 is a jet 216 (shown schematically in FIG. 2) that includes a central nozzle or passage 218. Particularly, in this embodiment, passage 218 of each jet 216 comprises a nozzle 218; however, in other embodiments, the passage 218 of each jet 216 may comprise other passages configured to increase a fluid velocity of a fluid flowing therethrough (e.g., orifices, etc.). In this arrangement, jets 216 are radially spaced from passage 204 of inlet adapter 202. In this embodiment, each jet 216 is releasably coupled to an inner surface of the angled passage 214 in which it is received. In this manner, jets 216 may be replaced in angled passages 214 with jets having different flow characteristics to allow the flow characteristics of suction booster assembly 200 to be tailored to the application; however, in other embodiments, jets 216 may be permanently coupled to inlet adapter 202 or formed monolithically therewith. The nozzle 218 of each jet 216 extends along a central jet axis 215. In this embodiment, the nozzle 218 of each jet 216 has a diameter of approximately 0.20"-0.500"; however, in other embodiments, the diameter of the nozzles 218 of jets 216 may vary. In this embodiment, inlet adapter 202 includes four circumferentially spaced jets 216 (each jet 216 being spaced equidistantly apart) received in four corresponding angled passages 214; however, in other embodiments, the number of jets 216 and/or angled passages 214 of inlet adapter 202 may vary.

Outlet adapter 240 of suction booster assembly 200 is generally cylindrical and has a first or inlet end 240A, a second or outlet end 240B opposite inlet end 240A, and a central bore or passage 242 defined by a generally cylindrical inner surface 244 extending between ends 240A, 240B. In this embodiment, the outlet end 240B of outlet adapter 240 couples with an end of the suction manifold 112 of fluid end 110 (e.g., via releasable fasteners). Additionally, in this embodiment, the inner surface 244 of outlet adapter 240 includes an annular shoulder 246 extending axially from inlet end 240A of outlet adapter 240. Cylinder 250 of suction booster assembly 200 has a first end 250A, a second end 250B opposite first end 250A, and a central bore or passage defined by a generally cylindrical inner surface 252 extending between ends 250A, 250B. In this embodiment, cylinder 250 houses venturi 260 of suction booster assembly 200 and, in this embodiment, the inner surface 252 of cylinder 250 includes an annular groove 254 that receives an annular retainer 256 for releasably coupling venturi 260 with cylinder 250 such that relative axial movement between venturi 260 and cylinder 250 is substantially restricted.

Venturi 260 of suction booster assembly 200 is generally cylindrical and has a first or inlet end 260A, a second or outlet end 260B opposite inlet end 260A, a central bore or venturi passage 262 defined by a generally cylindrical inner surface 264 extending between ends 260A, 260B, and a generally cylindrical outer surface 266 extending between ends 260A, 260B. When venturi 260 is received in cylinder 250, the inlet end 260A of venturi 260 is axially aligned or positioned adjacent the first end 250A of cylinder while outlet end 260B of venturi 260 contacts or is disposed directly adjacent the retainer 256 positioned proximal second end 250B of cylinder 250. Additionally, when venturi 260 is received in cylinder 250, inlet end 260A of venturi 260 contacts or is disposed directly adjacent outlet end 202B of inlet adapter 202. In this embodiment, an annular seal 268 is positioned radially between the outer surface 266 of venturi 260 and the inner surface 252 of cylinder 250 to restrict fluid flow through the annular interface formed therebetween.

In This embodiment, the inner surface 264 of venturi passage 262 includes a first or frustoconical or converging section 264A extending axially from inlet end 260A, a second or throat 264B extending axially from an end of converging section 264A positioned distal inlet end 260A of venturi 260, and a frustoconical or diverging section 264C extending axially between an end of throat 264B located distal converging section 264A and the outlet end 260B of venturi 260. In this configuration, moving from inlet end 260A to outlet end 260B of venturi 260: passage 264 of venturi 260 converges from a first or inlet diameter located at inlet end 260A to a second or throat diameter D2 located at the interface between converging section 264A and throat 264B, where second diameter D2 is smaller than the inlet diameter D1 of the passage 204 of inlet adapter 202, and diverges or expands (beginning at the interface between throat 264B and diverging section 264C) from throat diameter D2 to a third or outlet diameter D3 located at, or proximal to, outlet end 260B of venturi 260, where outlet diameter D3 is greater than throat diameter D2. The diverging section 264C of venturi 260 is disposed at a taper or diffuser angle θ to venturi axis 265. In this embodiment, diffuser angle θ is 5°; however, in other embodiments, diffuser angle θ may vary. For instance, in some embodiments, diffuser angle θ of diverging section 264C may be approximately between 5°-10°.

In this embodiment, throat diameter D2 of venturi passage 262 is approximately 20%-40% smaller than the inlet diameter D1 of inlet adapter 202, and an axial throat length 267 of throat 264B is approximately 100%-125% the size of throat diameter D2 (e.g., the same size or up to 25% greater in size than throat diameter D2); however, in other embodiments, the relationship in size between throat diameter D2 and the inlet diameter D1 of inlet adapter 202, as well as the relationship in size between throat length 267 and throat diameter D2, may vary. Additionally, in this embodiment, the inlet diameter D1 of inlet adapter 202 is greater than outlet diameter D3 of venturi 260; however, in other embodiments, outlet diameter D3 of venturi passage 262 may the same or greater than inlet diameter D1. Venturi passage 262 of venturi 260 extends along a central or venturi axis 265, where the jet axis 215 of the nozzle 218 of each jet 216 is disposed at a jet angle α to venturi axis 265 (each jet 216 being radially spaced from venturi axis 265). In this embodiment, the jet angle α formed between venturi axis 265 and each jet axis 215 is 15°; however, in other embodiments, the jet angle α may vary. Moreover, in some embodiments, the jet angle α may vary between each jet 216 of suction booster assembly 200 such that jets 216 of assembly 200 are disposed at varying jet angles α to venturi axis 265. In this embodiment, the jet axis 215 of the nozzle 218 of each jet 216 is directed towards (but does not necessarily intersect) venturi axis 265 such that drilling fluid jetted from jets 216 flows towards or in the direction of venturi axis 265. In this embodiment, the jet axis 215 of the nozzle 218 of each jet 216 intersects venturi axis 265 in a side view of suction booster assembly 200 (e.g., the side, cross-sectional view of suction booster assembly 200 shown in FIG. 3) at a location of venturi passage 262 defined by the diverging section 264C of the inner surface 264. In some embodiments, the jet axis 215 of the nozzle 218 of each jet 216 intersects venturi axis 265.

Housing 280 of suction booster assembly 200 is disposed about the outlet end 202B of inlet adapter 202 and the first end 250A of cylinder 250. In this embodiment, housing 280 is generally cylindrical and includes a first end 280A, a second end 280B opposite first end 280A, and a central bore or passage defined by a generally cylindrical inner surface 282 extending between ends 280A, 280B, and a generally cylindrical outer surface extending between ends 280A, 280B. In this embodiment, the inner surface 282 of housing 280 includes an annular shoulder 284 extending axially from second end 280B. Additionally, in this embodiment, housing 280 includes a radial port 286 (shown schematically in FIG. 2) extending between the outer surface of housing 280 and inner surface 282 of housing 280. Radial port 286 of housing 280 provides fluid communication between backflow line 130 and the channel 210 of inlet adapter 202. In this configuration, drilling fluid diverted from discharge line 120 is permitted to flow from backflow line 130 through radial port 286 and into angled passages 214 of inlet adapter 202 via channel 210, where the drilling fluid is injected or jetted into venturi passage 265 of venturi 260 via nozzles 218 of jets 216 at the jet angle α. In this embodiment, filter 132 of backflow line 130 prevents or at least mitigates the clogging of the nozzles 218 of jets 216 (e.g., filter 132 at least extends the service life of nozzles 216) by particulates or debris flowing into backflow line 130 from discharge line 120.

In this embodiment, the first end 250A of cylinder 250 is welded to the inner surface 282 of housing 280 at shoulder 284 while the second end 250B of cylinder 250 is welded to the inner surface 244 of outlet adapter 240 at shoulder 246. In this manner, sealing engagement is provided at the welded interface between cylinder 250 and shoulder 284 of housing 280, as well as the welded interface between cylinder 250 and shoulder 246 of outlet adapter 240, to prevent fluid communication between venturi passage 262 of venturi 260 and the environment surrounding suction booster assembly 200. Additionally, in this embodiment, the outer surface 208 is releasably coupled to the inner surface 282 of housing 280. In other embodiments, inlet adapter 202, outlet adapter 240, cylinder 250, and housing 280 may be releasably coupled to each other, using annular seals to prevent fluid communication between venturi passage 262 of venturi 260 and the surrounding environment. In still other embodiments, inlet adapter 202, outlet adapter 240, cylinder 250, and housing 280 may be monolithically formed from a single body or member.

As described above, the impedance of drilling fluid flowing through suction line 102 may intermittently decrease the amount of NPSH provided to the suction manifold 112 by the drilling fluid flowing through suction line 102. Additionally, in at least some applications, cavitation may occur in the drilling fluid flowing into and through suction manifold 112 if a threshold or minimum NPSH is not provided to pump 115 during the operation of mud pump system 100, where cavitation may damage or otherwise inhibit the operation of mud pump system 100. Suction booster assembly 200 boosts or increases the pressure of drilling fluid flowing therethrough before the drilling fluid enters suction manifold 112, preventing or at least reducing the risk of the NPSH provided to suction manifold 112 falling below the minimum NPSH required to avoid cavitation.

Particularly, the fluid velocity of drilling fluid supplied to jets 216 of suction booster assembly 200 via backflow line 130 substantially increases as the drilling fluid is jetted from the flow restriction provided by the relatively small diameter of the nozzles 218 of jets 216. The interaction between the high velocity drilling fluid jetted into venturi passage 265 from jets 216 and the drilling fluid of a suction fluid flow 270 entering venturi 265 from the passage 204 of inlet adapter 202 increases the pressure of suction fluid flow 270 as suction fluid flow 270 flows through the diverging portion of venturi passage 262 defined by the diverging section 264C of inner surface 264. In other words, the pressure (P1) of suction fluid flow 270 flowing through passage 204 of inlet adapter 202 is less than the pressure (P2) of suction fluid flow 270 as suction fluid flow 270 exits venturi passage 265 at the outlet end 260B of venturi 260.

In this manner, suction booster assembly 200 increases the pressure of the suction fluid flow 270 entering suction manifold 112 of fluid end 110. Additionally, suction booster assembly 200 increases the pressure of suction fluid flow 270 without requiring external power or the use of moving parts. Thus, suction booster assembly 200 pressurizes suction fluid flow 270 in an inexpensive and space-efficient (e.g., relative to a centrifugal pump, for instance) manner. The space-efficiency of suction booster assembly 200 may be particularly advantageous in applications that require a compact pump system, such as offshore well systems. Further, by using a plurality of jets 216 rather than a single jet (e.g., a jet positioned in passage 204 of inlet adapter 202), the nozzle 218 of each jet 216 may be reduced to flow a fixed amount of drilling fluid therethrough to thereby maximize the increase in fluid velocity of the drilling fluid jetted from jets 216 while minimizing turbulence in suction fluid flow 270 as suction fluid flow 270 receives the high velocity drilling fluid jetted from jets 216. Moreover, by positioning jets 216 circumferentially about venturi axis 265 within the angled passages 214 of inlet adapter 202, the axial length (e.g., the axial length between the inlet end 202A of inlet adapter 202 and the outlet end 240B of outlet adapter 240) and overall size of suction booster assembly 200 may be minimized.

Figure 4:
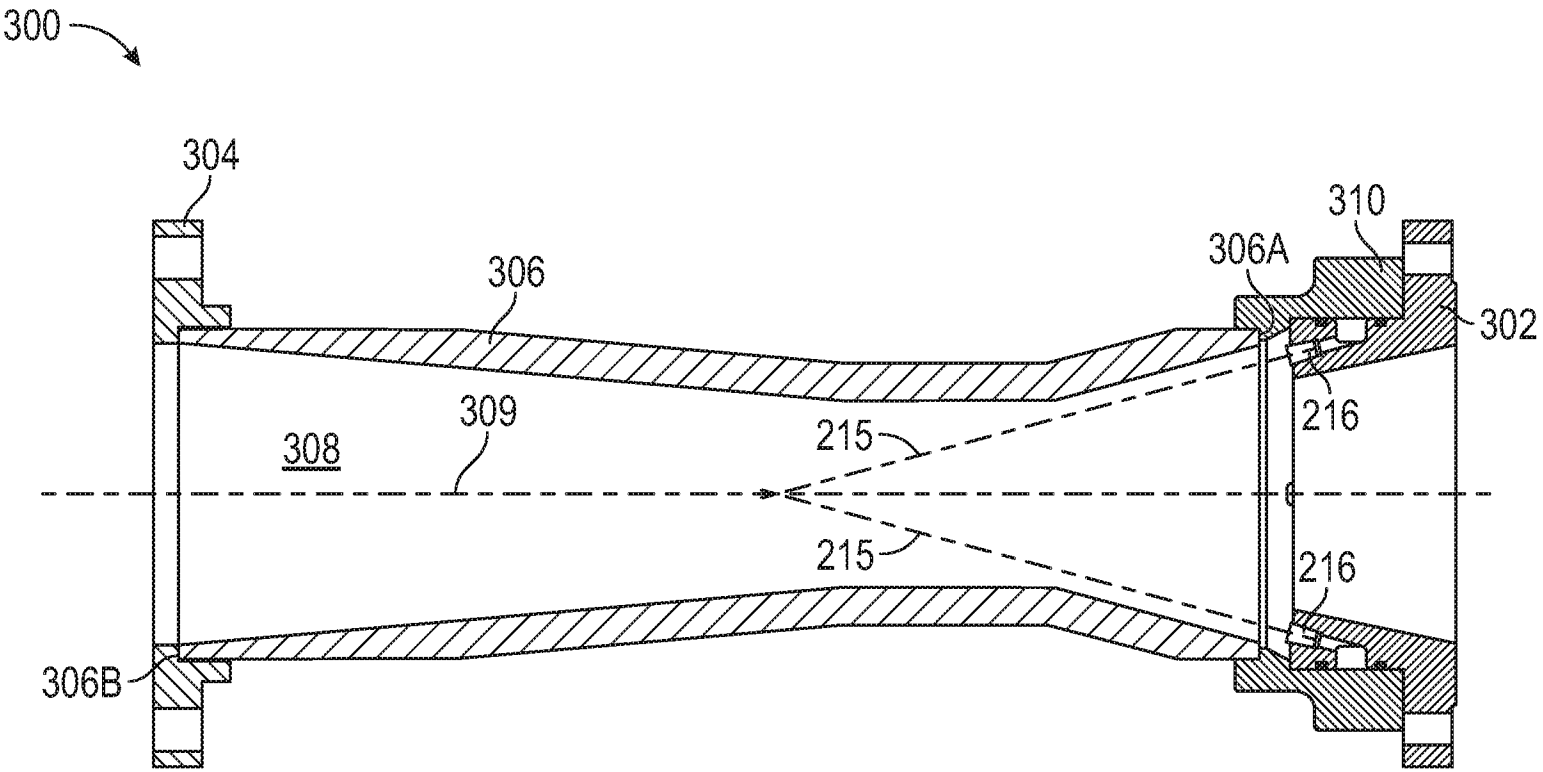
FIG. 4 is a side cross-sectional view of another embodiment of a suction booster assembly of the reciprocating pump system of FIG. 2 in accordance with principles disclosed herein.

Referring to FIGS. 1-4, another embodiment of a jet pump or suction booster assembly 300 for use in the mud pump system 100 is shown in FIG. 4. Particularly, the suction booster assembly 300 of the embodiment of FIG. 4 may be used in lieu of the suction booster assembly 200 shown in FIG. 3. Similar to suction booster assembly 200, the suction booster assembly 300 in this embodiment includes an inlet adapter 302 (connectable to an end of suction line 102), an outlet adapter 304 (connectable to the suction manifold 112 of fluid end 110), a venturi 306 including a venturi passage 308 having a central or venturi axis 309, and a housing 310. However, unlike suction booster assembly 200, the venturi 306 of suction booster assembly 300 is not received in an outer cylinder (e.g., cylinder 250 of assembly 200). Instead, in this embodiment, a first or inlet end 306A of venturi 306 couples directly with housing 310 while a second or outlet end 306B of venturi 306 couples directly with outlet adapter 304.

Figure 5:
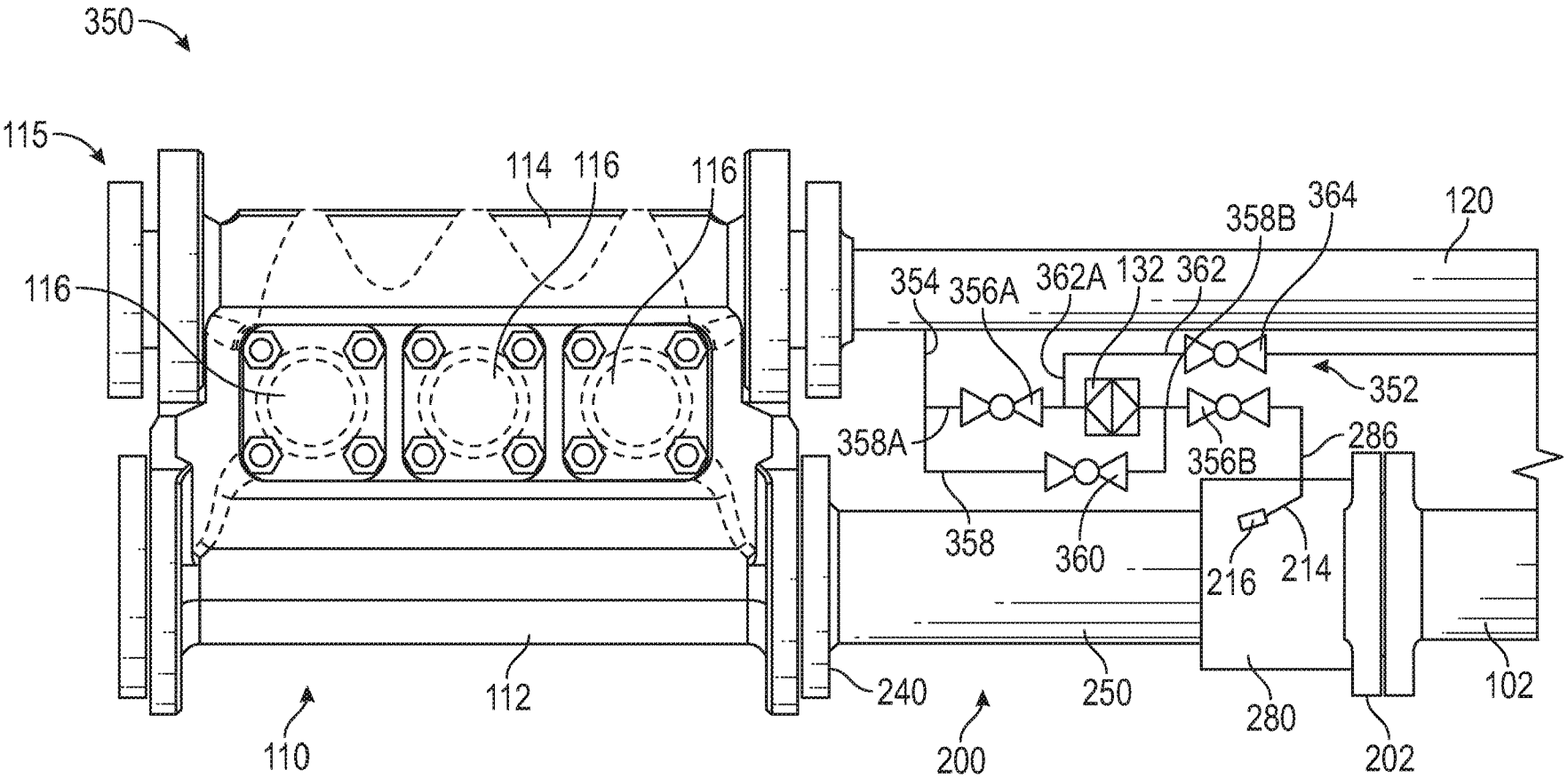
FIG. 5 is a side view of another embodiment of the reciprocating pump system of FIG. 1 in accordance with principles disclosed herein.

Referring to FIGS. 1, 2, and 5, another embodiment of a mud pump system 350 for use in drilling system 10 is shown in FIG. 5. The embodiment of mud pump system 350 shown in FIG. 5 is similar to the mud pump system 100 of FIG. 2 except that mud pump system 350 includes a backflush system 352 for backflushing or cleaning filter 132 to extend the service life of filter 132. In this embodiment, backflush system 352 includes a backflow line or conduit 354 (which includes filter 132) extending between discharge line 120 and suction booster assembly 200, a bypass line or conduit 358, and a drain line or conduit 362. Backflow line 354 includes a first valve 356A located upstream from filter 132 and a second valve 356B located downstream of filter 132. Bypass line 358 includes a first end 358A extending from backflow line 354 at a location upstream of first valve 356A, a second end 358B that intercepts backflow line 354 at a location downstream of filter 132 but upstream from second valve 356B, and a bypass valve 360 positioned between ends 358A, 358B. Drain line 362 includes a first end 362A that extends from backflow line 354 at a location between first valve 356A and filter 132, and a drain valve 364, where drain line 362 flows to a drain, a suction source (e.g., a pump, etc.), or other locations suitable for pump system 350.

In this embodiment, valves 356A, 356B of backflow line 352 may be closed to allow drilling fluid diverted from discharge line 120 to flow into the outlet of filter 132 via bypass line 35, and out of the inlet of filter 132 to a drain via drain line 362. In this manner, the flow of fluid may be reversed through filter 132 to thereby flow particulates and debris captured by filter 132 from filter 132 into a drain via drain line 362, thereby increasing the service life of filter 132. In some embodiments, suction may be applied to drain line 362 to assist with removing collected particulates and debris from filter 132. During normal operation of mud pump system 350, bypass valve 360 and drain valve 364 may be closed to permit drilling fluid diverted from discharge line 120 to flow into suction booster assembly 200.

Figure 6:
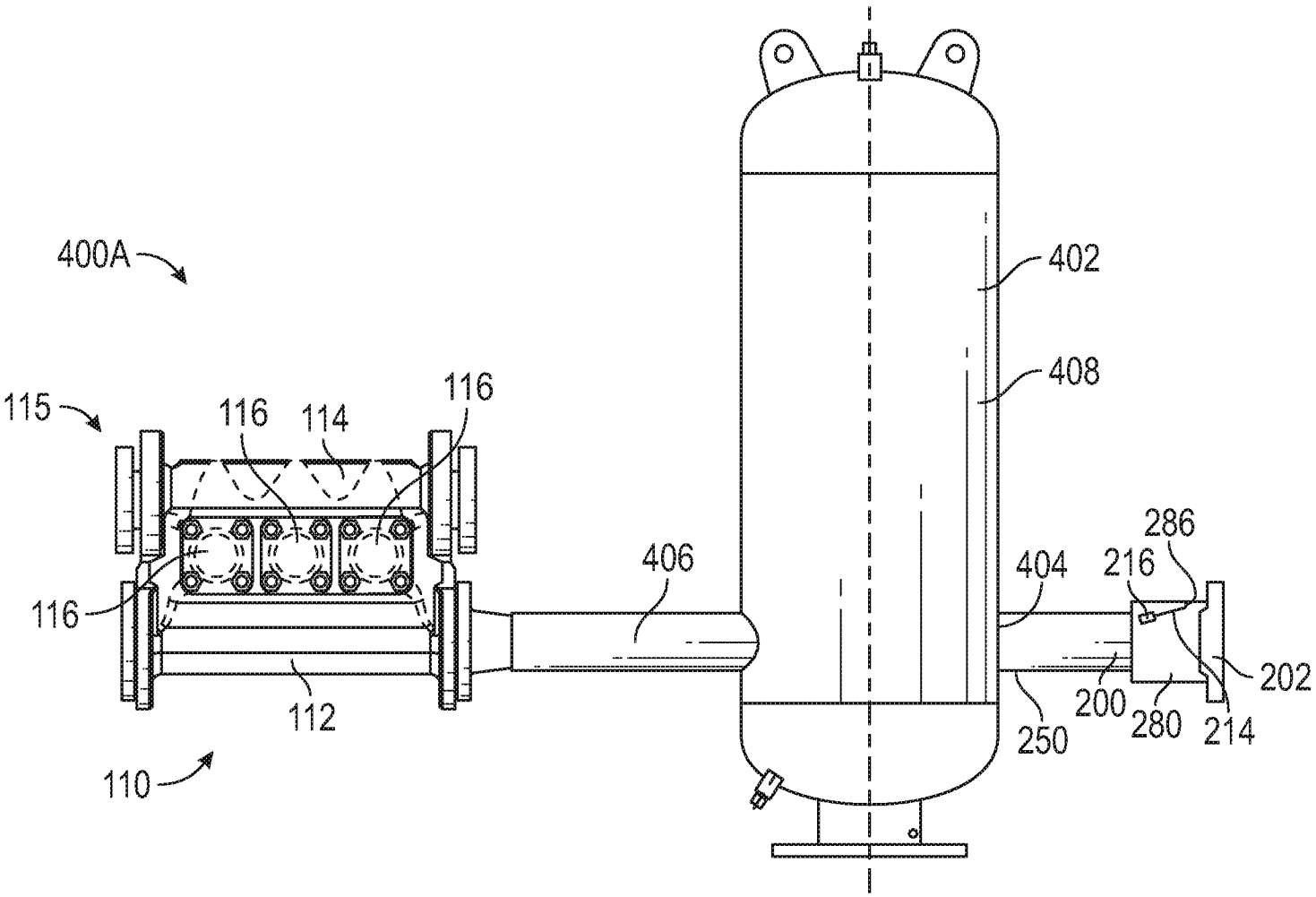
FIG. 6 is a side view of another embodiment of the reciprocating pump system of FIG. 1 in accordance with principles disclosed herein.
Figure 7:
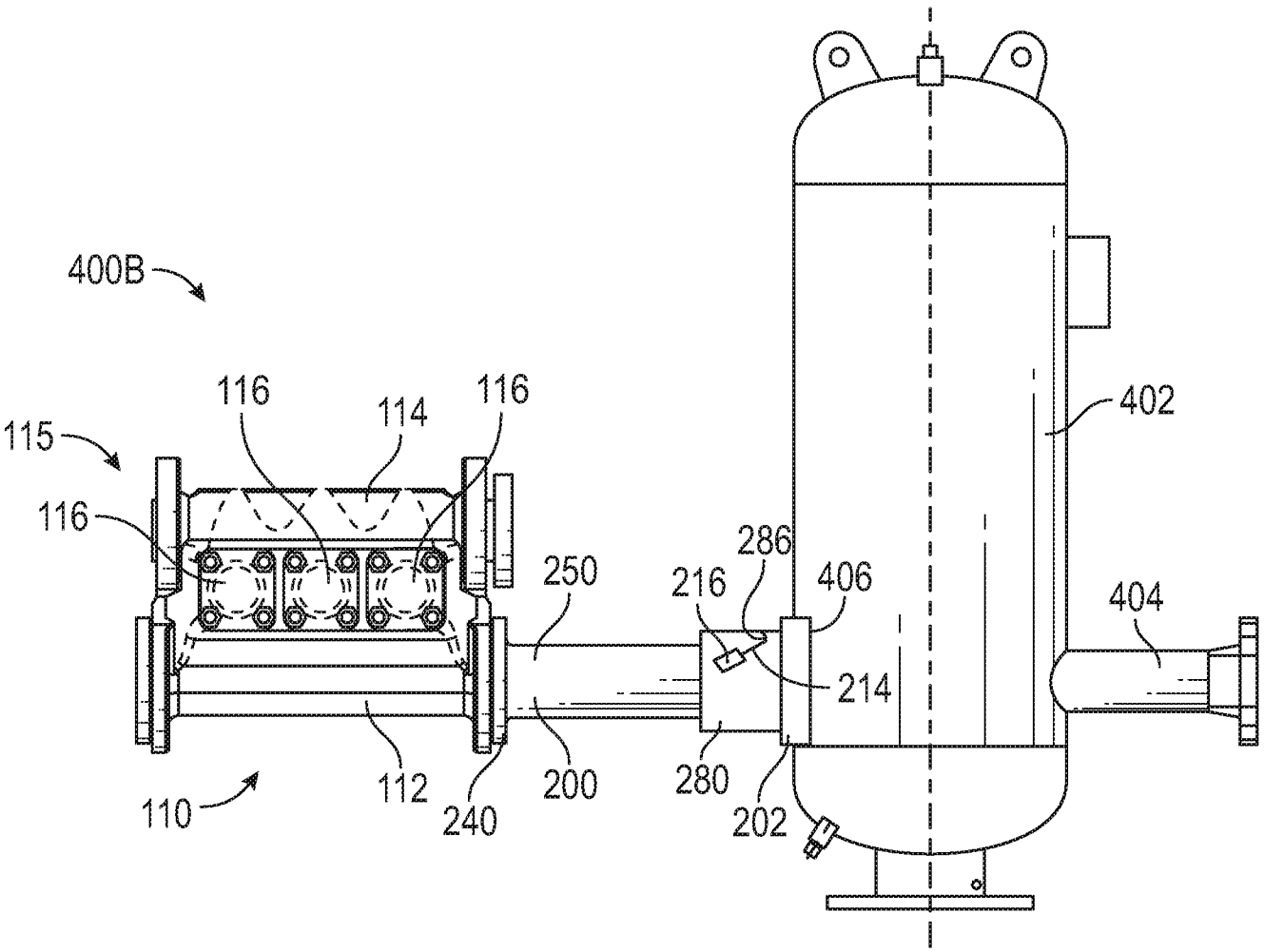
FIG. 7 is a side view of another embodiment of the reciprocating pump system of FIG. 1 in accordance with principles disclosed herein.

Referring to FIGS. 1, 2, 6, and 7, other embodiments of mud pump systems 400A, 400B for use in drilling system 10 are shown in FIGS. 6, 7, respectively. The embodiments of mud pump systems 400A, 400B shown in FIGS. 6, 7, respectively, are similar to the mud pump system 100 of FIG. 2 (suction line 102 and discharge line 120 are not shown in FIGS. 6, 7) except that mud pump systems 400A, 400B each include a fluid pulsation dampener 402 configured to dampen pressure and/or flowrate pulsations in flow of drilling fluid entering suction manifold 112 (e.g., suction fluid flow 270 shown in FIG. 3) of fluid end 110. In the embodiments of FIGS. 6, 7, pulsation dampener 402 comprises a fluid inlet 404, a fluid outlet 406, and a fluid vessel 408 located between fluid inlet 404 and fluid outlet 406.

The vessel 408 of pulsation dampener 402 retains a volume of drilling fluid therein during the operation of mud pump systems 400A, 400B, where the volume of drilling fluid received in vessel 408 acts to minimize variations in pressure and flowrate of drilling fluid (e.g., variations or pulsations introduced by equipment located upstream of pulsation dampener 402) flowing from pulsation dampener 402 into the suction manifold 112 of fluid end 110 which could otherwise cause cavitation or otherwise inhibit the operation of mud pump 115. Pulsation dampener 402 may be used in conjunction with a suction booster assembly (e.g., suction booster assembly 200) to both dampen pulsations and increase the pressure of drilling fluid flowing into suction manifold 112 of fluid end 110. For instance, in the embodiment of mud pump system 400A shown in FIG. 6, suction booster assembly 200 is positioned upstream of pulsation dampener 402, with the fluid inlet 404 of pulsation dampener 402 coupled to suction booster assembly 200 and the fluid outlet 406 of dampener 402 coupled to suction manifold 112 of fluid end 110. Conversely, in the embodiment of mud pump system 400B shown in FIG. 7, suction booster assembly 200 is positioned downstream of pulsation dampener 402, with the fluid inlet 404 of pulsation dampener 402 coupled to suction manifold 112 of fluid end 110 and the fluid outlet 406 of dampener 402 coupled to suction booster assembly 200.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A reciprocating pump system, comprising:

a reciprocating pump including a fluid end configured to receive a suction fluid flow and discharge a discharge fluid flow; and a suction booster assembly coupled to the fluid end, the suction booster assembly comprising:

a venturi including a venturi passage;

a jet configured to jet a fluid received from the discharge of the fluid end into the venturi passage;

a backflow line configured to divert the fluid received from the discharge fluid flow to the jet of the suction booster assembly, wherein the backflow line includes a filter coupled to the backflow line and configured to filter debris from the fluid provided to the jet;

a bypass line including a first end coupled to the backflow line at a first location that is upstream of a first valve of the backflow line, and a second end coupled to the backflow line at a second location that is between the filter and a second valve of the backflow line; and a drain line including a first end coupled to the backflow line at a third location that is between the first valve of the backflow line and the filter;

wherein the bypass line is configured to backflush the filter in response to closing the first valve and the second valve of the backflow line;

wherein the suction booster assembly is configured such that the jet of the suction booster assembly jetting the fluid received from the discharge of the fluid end into the venturi passage increases a pressure of the suction fluid flow.

2. The reciprocating pump system of claim 1, wherein the suction booster assembly comprises an inlet adapter coupled to the venturi, wherein the inlet adapter comprises a central passage and an angled passage spaced from the central passage that receives the jet.

3. The reciprocating pump system of claim 2, wherein the jet of the suction booster assembly includes a nozzle extending along a jet axis.

4. The reciprocating pump system of claim 2, wherein the suction booster assembly comprises:

a plurality of jets configured to jet the fluid received from the discharge of the fluid end into the venturi passage; and wherein the inlet adapter comprises a plurality of angled passages circumferentially spaced about the central passage of the inlet adapter.

5. The reciprocating pump system of claim 4, wherein the inlet adapter of the suction booster assembly has an outer surface comprising an annular channel that is in fluid communication with the plurality of angled passages.

6. The reciprocating pump system of claim 1, further comprising a pulsation dampener coupled to the fluid end of the reciprocating pump and the suction booster assembly, wherein the pulsation dampener is configured to dampen pulsations in pressure or flowrate of the suction fluid flow received by the fluid end.

7. The reciprocating pump system of claim 1, wherein the jet comprises a cylindrical body within which a cylindrical passage is located, and wherein the cylindrical body has a central axis coaxial with a jet axis of the jet.

8. The reciprocating pump system of claim 7, wherein the cylindrical passage extends entirely across an inner diameter of the cylindrical body.

9. The reciprocating pump system of claim 1, wherein the venturi passage of the suction booster assembly is defined by an inner surface of the venturi, wherein the inner surface comprises a converging section, a throat, and a diverging section; and the diverging section tapers in inner diameter by a taper angle that is less than an inclined angle of a jet axis of the jet, wherein the taper angle and the inclined angle are relative to a central axis of the venturi passage.

10. The reciprocating pump system of claim 9, wherein the inclined angle of the jet axis is equal to 10°.

11. A jet pump for increasing a suction pressure of a reciprocating pump, comprising:

a venturi including a venturi passage having a central axis;

an inlet adapter coupled to the venturi and comprising a central passage and an angled passage that receives a jet;

a backflow line configured to divert a portion of a discharge fluid flow discharged from the reciprocating pump to the jet, wherein the backflow line includes a filter coupled to the backflow line and configured to filter debris from the portion of the discharge fluid flow provided to the jet a bypass line including a first end coupled to the backflow line at a first location that is upstream of a first valve of the backflow line, and a second end coupled to the backflow line at a second location that is between the filter and a second valve of the backflow line; and a drain line including a first end couples to the backflow line at a third location that is between the first valve of the backflow line and the filter;

wherein the bypass line is configured to backflush the filter in response to closing the first valve and the second valve of the backflow line;

wherein the jet includes a nozzle extending along a jet axis disposed at an inclined angle relative to the central axis of the venturi passage, and wherein the jet defines the jet axis and a cylindrical passage extending through the jet, the jet axis extending centrally through the cylindrical passage;

wherein the venturi passage is defined by an inner surface of the venturi, wherein the inner surface comprises a converging section, a throat, and a diverging section and wherein the jet axis crosses the central axis of the venturi passage from a side view of the venturi passage within the diverging section of the inner surface of the venturi passage.

12. The jet pump of claim 11, wherein the angled passage is radially spaced from the central passage of the inlet adapter.

13. The jet pump of claim 11, further comprising:

a plurality of jets, each of the plurality of the jets includes a nozzle extending along a corresponding jet axis disposed at the inclined angle relative to the central axis of the venturi passage;

wherein the inlet adapter comprises a plurality of angled passages circumferentially spaced about the central passage of the inlet adapter.

14. The jet pump of claim 13, wherein the inlet adapter has an outer surface comprising an annular channel that is in fluid communication with the plurality of angled passages.

15. The jet pump of claim 11, wherein the jet axis intersects the central axis of the venturi passage at a location in the venturi passage that, in the side view of the venturi passage, is within the diverging section of the inner surface of the venturi passage.

16. The jet pump of claim 11, wherein the inlet adapter comprises a radial port in fluid communication with the angled passage, and wherein the inlet adapter is configured to receive the portion of the discharge fluid flow discharged from the reciprocating pump.

17. The jet pump of claim 11, wherein the jet comprises a cylindrical body within which the cylindrical passage is located, and wherein the cylindrical body has a central axis coaxial with the jet axis.

18. The jet pump of claim 17, wherein the cylindrical passage extends entirely across an inner diameter of the cylindrical body.

19. A method for increasing a suction pressure of a reciprocating pump, comprising:

(a) diverting a portion of a discharge fluid flow from a discharge line coupled to the reciprocating pump through a backflow line that includes a filter configured to filter debris from the portion of the discharge fluid flow;

(b) flowing the diverted portion of the discharge fluid flow through a cylindrical passage defined by a jet, wherein a jet axis defined by the jet extends centrally through the cylindrical passage at an inclined angle relative to a central axis of a venturi passage, wherein the venturi passage is defined by an inner surface of a venturi, wherein the inner surface comprises a converging section, a throat, and a diverging section;

(c) wherein, from a side view of the venturi passage, the jet axis crosses the central axis of the venturi passage within the diverging section of the inner surface of the venturi passage of the jet extending along the jet axis;

(d) jetting the diverted portion of the discharge fluid flow into a suction fluid flow;

(e) flowing the suction fluid flow through the venturi passage;

(f) flowing the portion of the discharge fluid flow through a bypass line including a first end coupled to the backflow line at a first location that is upstream of a first valve of the backflow line, and a second end coupled to the backflow line at a second location that is between the filter and a second valve of the backflow line;

(g) closing the first valve and the second valve of the backflow line to backflush the filter using the portion of the discharge fluid flow; and (h) flowing the portion of the discharge fluid flow through a drain line including a first end coupled to the backflow line at a third location that is between the first valve of the backflow line and the filter.

20. The method of claim 19, further comprising:

increasing the flow velocity of the diverted portion of the discharge fluid flow by jetting the diverted portion of the discharge fluid flow from a plurality of jets, wherein each of the plurality of jets are radially spaced from the central axis of the venturi passage.

21. The method of claim 19, further comprising:

flowing the suction fluid flow through a pulsation dampener coupled to the reciprocating pump.

22. The method of claim 19, further comprising:

flowing the diverted portion of the discharge fluid flow through the filter located upstream of the jet; and j) reversing a direction of the diverted portion of the discharge fluid flow through the filter to remove debris from the filter.

* * * * *